United States Patent [19]

Zoueki

[11] Patent Number: 4,713,912

[45] Date of Patent: Dec. 22, 1987

[54] LENS AND PATTERN HOLDER

[76] Inventor: Georges Zoueki, 4812 Verdun Avenue, Verdun, Quebec, Canada, H4G 1N1

[21] Appl. No.: 840,930

[22] Filed: Mar. 18, 1986

[30] Foreign Application Priority Data

May 8, 1985 [CA] Canada ..... 481082

[51] Int. Cl.[4] ..... B24B 9/14

[52] U.S. Cl. ..... 51/101 LG; 51/102; 51/216 LP

[58] Field of Search ..... 51/101 R, 101 LG, 102, 51/105 LG, 106 R, 106 LG, 208, 216 LP, 283 E, 284 E

[56] References Cited

U.S. PATENT DOCUMENTS

| | | | |
|---|---|---|---|
| 2,166,037 | 7/1939 | Campos | 51/101 LG |
| 3,170,374 | 2/1965 | Clar | 51/101 LG |
| 3,381,356 | 5/1968 | Santinelli | 51/216 LP |
| 3,962,833 | 6/1976 | Johnson | 51/216 LP X |
| 4,406,091 | 9/1983 | Eckardt et al. | 51/101 R |
| 4,541,760 | 9/1985 | Zoueki | 51/102 X |

FOREIGN PATENT DOCUMENTS

| | | | |
|---|---|---|---|
| 173447 | 10/1982 | Japan | 51/101 LG |
| 147708 | 10/1921 | United Kingdom | 51/101 LG |

*Primary Examiner*—Robert P. Olszewski

*Attorney, Agent, or Firm*—Schwartz, Jeffery, Schwaab, Mack, Blumenthal & Evans

[57] ABSTRACT

A lens and pattern holder for use with a grinding tool comprising a rotary grinding ring mounted in coaxial relationship with respect to a grinding ring of the same diameter. The holder comprises a solid body having a pair of opposite surfaces spaced apart so that the peripheries thereof respectively face the grinding and guiding rings of the tool. A pair of pins projects upwardly from one of the opposite surfaces of the body for detachably connecting thereto a pattern having a peripheral edge extending away from the periphery of the one surface. Another pair of pins or a sticking pad is provided on the other opposite surface of the body for detachably mounting thereon another pattern or a lens, respectively. Visible dots are also provided on the one surface of the body for properly positioning and aligning the lens with respect to the pattern connected to the opposite surface of this body. In use, a finishing lens mounted on the other surface of the body can be used as a guide for shaping and finishing the peripheral edge of a blank pattern connected to the one surface of the body. Alternatively, a finished pattern mounted on the one surface of the body can be used as a guide for shaping and finishing the peripherical edge of a lens or of a blank pattern.

7 Claims, 10 Drawing Figures

LENS AND PATTERN HOLDER

BACKGROUND OF THE INVENTION (a) Field of the Invention

The present invention relates to a lens and pattern holder for use with a grinding tool to cut a pattern out of a demonstration lens generally provided with any new glasses frame or out of a <<real>> ophtalmic lens.

The invention also relates to a lens and pattern holder for use to cut a lens from a pattern or to duplicate a pattern from another pattern.

(b) Brief Description of the Prior Art

It is of common practice for the manufacturers of glasses frames to give a pattern to the optician with every new frame. This pattern is, in fact, a jig suitable to provide the general parameters necessary to cut a lens so that this lens fits to the frames. Usually, these parameters are the general axes of the lens and its outer contour.

A major problem encountered by the opticians is to keep in store all the patterns necessary to satisfy his consummers' requirement. There is one given pattern for each frame. Since the number of frames that an optician must have or had in store is rather important, the number of patterns to keep in store in order to be able to cut lenses fitting with the existing or old kind of frames is very important too and call for a very well organized classification. Indeed, if a pattern corresponding to a given frame is lost and a customer wants the frame corresponding to this pattern for his new glasses or, alternatively, needs new lenses with his own frame corresponding to this lost pattern, the optician is obliged to contact the frame's manufacturer in order to obtain a new pattern, thereby substantially delaying the delivery of the new glasses to the customer.

In addition, it often happens that patterns supplied to the opticians by some of the frames' manufacturers are of very poor quality, thereby making their use difficult and/or impossible.

OBJECTS OF THE INVENTION

An object of the present invention is to provide a lens and pattern holder very simple in structure, which holder can be used with a very simple grinding tool to cut a new pattern that can subsequently be used for cutting an ophtalmic lens capable of fitting to a given frame using, as a guide, either a demonstration lens of the given frame or, in the case of a frame already used by a customer, from an ophtalmic lens supported by this frame.

Another object of the invention is to provide a lens and pattern holder which can alternatively be used for cutting an ophtalmic lens or cutting a blank pattern from an existing pattern in order to provide a lens capable of fitting with the frame corresponding to this pattern, or for duplicating an existing pattern.

A further object of the invention is to provide a lens and pattern holder which makes it possible to cut ophtalmic lenses capable of fitting to a given frame in a very easy manner such as polycarbonate lenses that require a dry grinding machine because it cannot be grounded on conventional automatic edgers.

SUMMARY OF THE INVENTION

In accordance with the invention, these objects are achieved with a lens and pattern holder for use in a grinding to comprising a rotary grinding ring mounted in a coaxial relationship with respect to a guiding ring of the same diameter, which holder comprises:

a solid body having a pair of opposite surfaces spaced apart so that the peripheries thereof respectively face the grinding ring and guiding ring of the grinding tool;

means on one of the opposite surfaces of the body for detachably connecting thereto a pattern having a peripherical edge extending away from the periphery of the one surface, these connecting means consisting of two pins spaced apart on the one surface and projecting therefrom to engage a pair of corresponding holes provided in the pattern;

means on the other opposite surface of the body for detachably mounting thereon a lens; and visual means on this other surface for use as a guide to properly position and align the lens with respect to the pattern connected to the opposite surface of the body when mounting this lens onto the other surface.

In use, a finished lens mounted on the other surface of the body can be used as a guide for shaping and finishing the peripherical edge of a blank pattern connected to the one surface of the body, such a shaping and finishing being obtained by pressing and rotating the finished lens and blank pattern against the guiding ring and the grinding ring, respectively. Alternatively, a finished pattern mounted on the one surface of the body can be used as a guide for shaping and finishing the peripherical edge of a lens, such a finishing being obtained by pressing and rotating the finished pattern and the lens against the guiding ring and the grinding ring, respectively.

In accordance with a first embodiment of the invention, the solid body has a main axis perpendicular to its opposite surfaces and the pins used for connecting the pattern on the one surface of the body are symmetrically positioned with respect to this main axis. The means for detachably mounting a lens onto the other surface of the body consists of a sticking pad and the visual means for positioning and aligning the lens consists of three visible dots aligned onto the other surface of the body, one of these dots being centrally positioned onto the main axis of the body while the two other dots are symmetrically positioned with respect to this main axis close to the periphery of this other surface.

In order to provide a better support to the lens, the other surface of the body on which the lens is detachably mounted, can be slightly convex or slightly concave.

In accordance with another embodiment of the invention especially intended for use to diplicate an existing pattern, the solid body has a main axis perpendicular to its opposite surfaces and the pins used for connecting the pattern of the one surface are symmetrically positioned with respect to this main axis. In this particular case, the means for detachably mounting a lens onto the other surface of the body are, together with the visual means, substituted for another set of connecting pins similar to those projecting from the one surface, for detachably mounting another pattern instead of mounting a lens.

BRIEF DESCRIPTION OF THE DRAWINGS

A non restrictive description of three preferred embodiments of the invention will now be given with reference to the accompamying drawings in which.

DESCRIPTION OF THREE PREFERRED EMBODIMENTS

Figure 1:
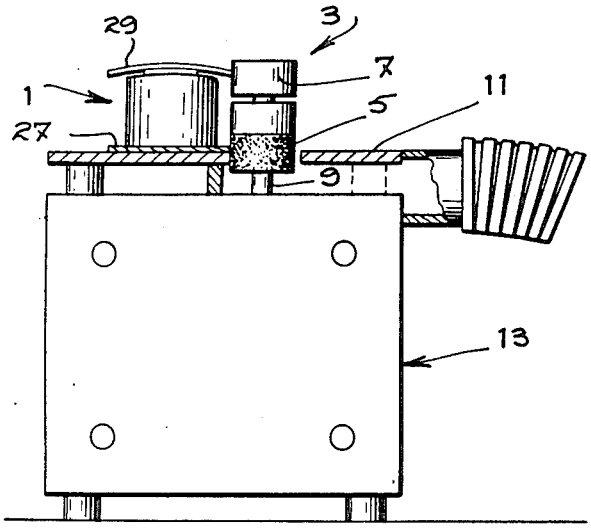
FIG. 1 is a side elevational view of a lens and pattern holder according to the invention for use to cut a pattern from an existing lens, which holder is shown in use with a grinding apparatus.
Figure 2:
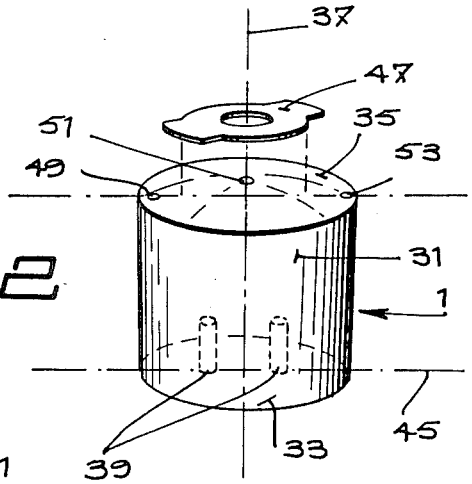
FIG. 2 is a perspective view of the holder shown in FIG. 1.
Figure 3:
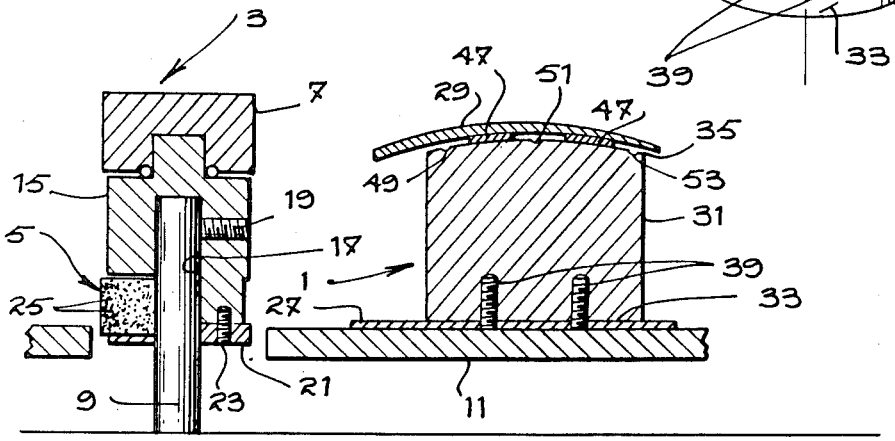
FIG. 3 is an enlarged, cross-sectional view of the holder and of the grinding tool shown in FIG. 1.

The lens and pattern holder 1 shown in FIGS. 1 to 3 of the drawings, is intended to be used with a grinding tool 3 comprising a rotary grinding or sanding ring 5 mounted in coaxial relationship with respect to a guiding ring 7 of the same diameter. The grinding tool 3 can be mounted onto a shaft 9 driven by the small electrical motor (not shown) of an apparatus 13 provided with an upper flat working table 11 through which the shaft 9 extends. As apparatus 13, use can be made of the multipurpose apparatus disclosed and claimed in U.S. Pat. No. 4,541,760 issued on September 1985 in the name of the same inventor.

As shown in greater details in FIG. 3, the grinding tool 3 comprises a drum 15 preferably made of brass, which drum is upwardly and coaxially extended with a ball-bearing-mounted, cylindrical plastic top acting as guiding ring 7. The bottom end of the drum 15 opposite to the plastic top 7 is provided with a central hole 17 sized to fit the shaft 9. A small, radially extending setscrew 19 is provided into the drum 15 for detachably fixing it on the shaft 9.

The bottom end of the drum 15 is shaped to receive and support an interchangeably grinding ring 5 having the same external diameter as the top 7. This ring 5 which can be made of brass with an outer covering of abrasive diamonds, can be hold in position by means of one ore more cap screws 23. By a way of example, the drum may have a diameter equal to 25 mm and a height equal to 33 mm. The plastic top 7 may have a height of 15 mm. Advantageously, the drum 15 is positioned onto the shaft 9 so that the grinding ring 5 extends substantially at the level of the working table 11 of the apparatus 13, as clearly shown in FIGS. 1 and 3.

The lens and pattern holder 1 is intended to be used with the grinding tool 3 for cutting a pattern 27 from a demonstration or ophtalmic lens 29. More particularly, the holder 1 is intended to be used with the tool 3 for shaping and finishing the peripherical edge of a blank pattern 27 using the lens 29 as a guide, in order to subsequently use this pattern for the manufacture of another lens capable of fitting the frame of the glasses from which comes the lens 29.

As better shown in FIG. 2, the holder 1 comprises a solid body 31 having a pair of opposite surfaces 33 and 35 spaced apart so that the peripheries thereof respectively face the grinding ring 5 and the guiding ring 7 when the holder 1 is used for cutting a pattern 27 from a lens 29. The body 31 has a main axis 37 perpendicular to its opposite surfaces 33 and 35 and comprises means on its surface 33 which is flat, for detachably connecting thereto the pattern 27 to be cut, such a cutting making it compulsory that the pattern 27 have a peripherical edge extending away from the periphery of the surface 33 of the body 31.

Figure 4A:
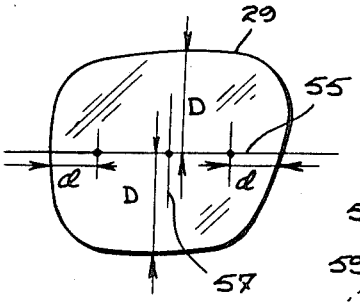
FIG. 4(*a*), (*b*), (*c*) and (*d*) are schematic representations of some steps to be followed when using the holder shown in FIGS. 1 to 3.
Figure 4B:
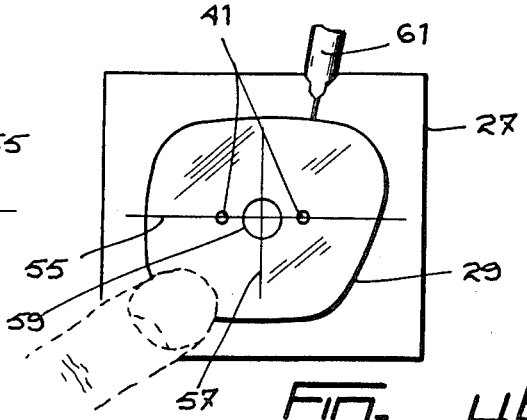

As clearly shown in FIGS. 2 and 3, these means for connecting the pattern 27 consists of two spaced apart pins 39 projecting from the surface 33 to engage a pair of corresponding holes 41 provided in the blank pattern to be cut (see FIG. 4*b*). These pins 39 are symmetrically positioned with respect to the main axis 37 and are sized to extend sufficiently to fit the holes 41 of the blank pattern 27. In this connection, it should be noted that the use of flat patterns or blank patterns provided with fitting holes 41 is very standard in this field. By way of example, reference can be made to the flat patterns that are conventionally used with the automatic edgers provided with a SHURRON attachment, which patterns comprise two positioning holes having a diameter of 2 mm, the distance between the centers of these holes being equal to 16 mm.

In order to make the manipulation of the holder easier, the body 1 may comprise two lateral flat edges 43 (see FIG. 4*d*) extending parallel to the plane 45 passing through the axes of the pins 39.

Means are provided on the other surface 35 of the body 31 for detachably mounting thereon the lens 29. These means for detachably mounting the lens 29 may consist of a sticking pad 47 like the one sold to the opticians by the 3M company under the tradename LEAP PAD. The surface 35 on which the pad 47 may be sticked for detachably mounting the lens 29 is advantageously shaped to be convex. This convexity may be, for example, of 6 diopters to fit most of the ophtalmic lenses. In addition to the pad 47, the upper surface 35 to the holder body 31 is provided with visual means for use as a guide to properly position and align the lens 29 with respect to the pattern 27 connected to the opposite surface 33 when mounting the lens onto the surface 35. As shown in FIGS. 2 and 3, these visual means preferably consist of three colored dots 49, 51 and 53 which are aligned with respect to the upper surface 35 of the body 31 so as to extend in the plane 45 passing through the axes of the pins 39. The dot 51 is centrally positioned onto the main axis 37 of the body so as to be visible through a central hole generally provided into the sticking pad 47. The other dots 49 and 53 are symmetrically positioned with respect to the main axis 37 close to the periphery of the surface 35.

The holder 1 can be made of plastic material, such as DELRIN (trademark). It may have a diameter of 38 m and a height of 32 mm so as to fit with the rings 5 and 7 of the grinding tool 3. In the case where the body has two lateral flat sides 43, the distance between these flat sides may be equal to 32 mm.

The lens and pattern holder 1 previously described can be used as follows.

First of all, the lens 29 intended to be used as a guide for cutting the pattern 27 is positioned with the frame of the glasses to which it belongs, into a lensometer. The three dots of the lensometer are then aligned with respect to the lens so as to be equidistant from the vertical edges and the horizontal edges of the lens 29, respectively (see FIG. 4(*a*)). After such an alignment, the lens 29 can be removed from the frame and an horizontal line 55 can be drawn to join the small dots made with the lensometer. A vertical line 57 can also be drawn perpendicularly to the line 55 in the middle thereof (see FIGS. 4*a* and 4*b*). To draw these lines, use can be made of a fine permanent black ink such as the one sold under the tradename STAEDLER LUMO COLOUR 313.

Subsequently, the cross defined by the lines 55 and 57 is aligned with the pin receiving holes 41 of the blank pattern 27 to be cut. The point at the intersection of the lines 55 and 57 must, during this step, be positioned just in the middle the holes 41, where usually stands a large central hole 59 in most of the presently available blank pattern 27. After such a lining up, a fine line can be traced around the lens 29 using a pen 61, while this lens 29 is firmly hold in place (see FIG. 4*b*).

Then, the blank pattern 27 is cut with scissors following the traced line in order to roughly define the general contour of the pattern to be cut and a sticking pad 47 is applied to the convex surface 35 of the holder 1 in such a manner as not to cover the dots 49, 51 and 53.

Figure 4C:
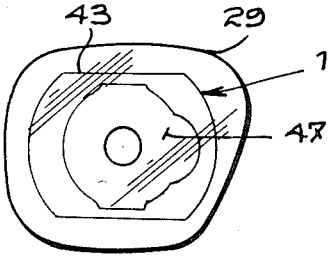
Figure 4D:
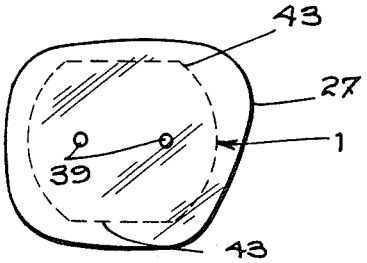

The cross defined by the line 55 and 57 onto the lens 29 is lined up with the dots 49, 51 and 53 which thus provide a visual means for properly positioning the lens 29 onto the pad 45 with respect to the holder 1 (see FIG. 4*c*). In a further step, the precut blank pattern 27 is installed onto the pins 39 projecting outwardly of the surface 33 opposite to the surface 35 where is stuck the lens 29. During this operation, it is important to check that the top and nasal sides of the lens and pattern are aligned accordingly (see FIG. 4*d*).

Then, the holder assembly is ready to make a pattern identical to the lens 29, provided that the alignment axis and centration are correct. To do so, the holder 1 with the pattern 27 and the lens 29 connected thereto is placed onto the working table 11 as shown in FIG. 1 with the blank pattern 27 facing the grinding ring 5 and the lens 29 facing the guiding ring 7 free to rotate about its ball bearing. While applying a vertical pressure on it, the holder may be moved towards the grinding tool 3 while the same is rotated. When contact is made with the diamond abrasives, the assembly may be rotated in a direction opposite to the direction of rotation of the ring 5 until the pattern 27 is properly finished.

Tests conducted by the inventor have shown a better result are achieved by going around the lens twice. The first rough turn must be made without stopping the grinding tool 3 from rotating. The second finishing turn can be made with more pressure.

As can be easily understood, the grinding ring 5 will grind the rough pattern 27 until the lens reaches the guiding ring 7. This guiding ring 7 then will not allow more cutting than the actual size of the lens, thereby making the operation extremely simple and efficient.

Figure 7:
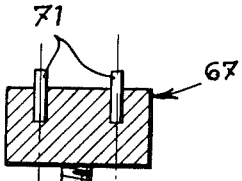
FIG. 7 is a cross-sectional view of a knob for use with the holders of FIGS. 5 or 6 to hold the pattern used as a guide.
Figure 5:
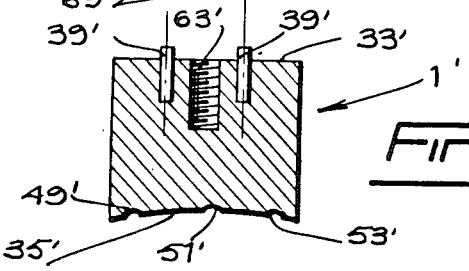
FIG. 5 is a cross-sectional view of another holder for use to a lens from a pattern.

In accordance with another embodiment to the invention shown in FIG. 5, the holder 1' is intended to be used for cutting a lens from a pattern. In this particular case, the lens receiving surface 35' is concave instead of being convex so that only the peripherical edge of the lens to be cut is in contact with the working table 11. The surface 35' is also provided with coloured dots 49', 51' and 53' for use to position and align the lens to be cut with the pattern. The concavity of the surface 35' can be of 6 diopters, for the same reason as above. The other surface 33' of the holder 1' is provided with two pins 39' for use to fix the pattern acting as a guide for cutting the lens. A threaded blind hole 63' may be provided into the body 1' to receive the screw 65 of a small knob 67 shown in FIG. 7. The main purpose of this knob is to firmly hold the pattern on top of the holder 1' when the same is used. The threaded hole 63' and the screw 65 are preferably positioned coaxial with the main axis of the body 1' to match with the central hole 59 generally provided in most of the commonly available blank 27.

The holder 1' can be used substantially as described hereinabove with respect to the holder 1, except that, in this particular case, the pattern 27 is in contact with the guiding ring 7 whereas the lens 29 to be cut is pressed against the diamond abrasives 25 of the grinding ring 5.

Figure 6:
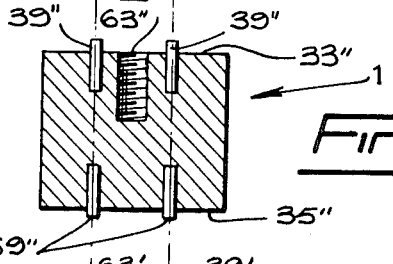
FIG. 6 is a cross-sectional view of a further holder for use to cut a new pattern from an existing pattern.

In a third embodiment of the invention shown in FIG. 6, the holder 1'' is intended to be used for cutting a pattern from an other pattern. The upper surface of this holder 1'' is substantially identical to the upper surface of the holder 1' and comprises a pair of pins 39'' and a central hole 63'' for use to mount the pattern used as a guide. However, the means used for detachably mounting a lens onto the surface 35 and 35' of the body are, together with the visual means used for aligning this lens, substituted for a set of connecting pins 69'' aligned with the pins 39'', which pins 69'' project downwardly from the flat surface 35'' for mounting another pattern to be cut instead of mounting a lens.

The operation of this further holder 1'' is substantially identical to the operation of the previous holder 1 and 1'.

It should be noted that the knob 67 may be provided with two long pins 71 on its top for allowing insertion of two patterns one above the other. These pins may be used, inter alia, for fusing two or more patterns together whenever necessary.

What is claimed is:

1. A lens and pattern holder for use with a grinding tool comprising a rotary grinding ring mounted in coaxial relationship with respect to a guiding ring of the same diameter, said holder comprising:

a solid body having a pair of opposite surfaces spaced apart so that the peripheries thereof respectively face said grinding ring and guiding ring, said solid body having a main axis perpendicular to its opposite surfaces;

means on one of said opposite surfaces for detachably connecting thereto a relatively thin pattern having a peripherical edge extending away from the periphery of said one surface, said connecting means comprising a single set of two pins spaced apart on said one surface and projecting therefrom to engage a pair of corrsponding holes provided in said pattern, said pins extending substantially through said pattern and being symmetrically positioned with respect to the main axis of said body;

means on the other of said opposite surfaces for detachably mounting thereon a lens, said mounting menas comprising a sticking pad; and visual means on said other surface for use as a guide to properly position and align the lens with respect to the pattern connected to the one surface of said body when mounting said lens onto said other surface, said visual means comprising three visible dots aligned onto said other surface of said body so as to extend in a plane passing through the axes of the pins, one of said dots being centrally positioned onto the main axis of said body while the two other dots are symmetrically positioned close to the periphery of said other surface, whereby a finished lens mounted on the other surface of said body can be used as a guide for shaping and finishing the peripherical edge of a blank pattern connected to the one surface of said body, such a shaping and finishing being obtained by pressing and rotating said finished lens and blank pattern against said guiding ring and said grinding ring, respectively, or, alternative, a finished pattern mounted on the one surface of said body can be used as a guide for shaping and finishing the peripherical edge of a lens, such a finishing being obtained by pressing and rotating said finished pattern and said lens against said guiding ring and said grinding ring, respectively.

2. The lens and pattern holder of claim 1, wherein said other surface of the body on which a lens may be detachably mounted is slightly convex.

3. The lens and pattern holder of claim 2, wherein the solid body is made of plastic material.

4. The lens and pattern holder of claim 1, wherein said other surface of the body on which a lens may be detachably mounted is slightly concave.

5. The lens and pattern holder of claim 4, further comprising a threaded blind-hole coaxial with the main axis of the body, said hole extending in said body from the one surface thereof.

6. The lens and pattern holder of claim 5, wherein the solid body is made of plastic material.

7. A pattern holder for use with a grinding tool comprising a rotary grinding ring mounted in coaxial relationship with respect to a guiding ring of the same diameter, said holder comprising:

a solid body having a pair of opposite surfaces spaced apart so that the peripheries thereof respectively face said grinding and guiding rings, said solid body having a main axis perpendicular to its opposite surfaces;

means on one of said opposite surfaces for a detachably connecting thereto a relatively thin first pattern having a peripherical edge extending away from the periphery of said one surface, said connecting means comprising two pins spaced apart on said one surface and projecting therefrom to engage a pair of corresponding holes provided in said first pattern, said pins connecting said first pattern on the one surface symmetricaly positioned with respect to said main axis;

a threaded blind-hole coaxial with the main axis of said body, said blind-hole extending inside said body from the one surface thereof; and a set of connecting pins projecting from the other of said opposite surfaces of said body for detachably mounting another pattern provided with a corresponding set of holes onto said other surface, the pins of said set being aligned with the pins projecting from the one surface of said body, whereby an already finished pattern mounted on the other surafce of said body can be used as a guide for shaping and finishing the peripherical edge of a blank pattern mounted on the one surface of said body, such a shaping and finishing being obtained by pressing and rotating said finished and unfinished patterns against said guiding ring and said grinding ring, respectively.

* * * * *